US006966669B2

(12) United States Patent
Hussaini et al.

(10) Patent No.: US 6,966,669 B2
(45) Date of Patent: Nov. 22, 2005

(54) UTILITY LIGHT

(75) Inventors: Saied Hussaini, Miami, FL (US); Marc Iacovelli, Miami, FL (US)

(73) Assignee: Rally Manufacturing, Inc., Miami, FL (US)

( * ) Notice: Subject to any disclaimer, the term of this patent is extended or adjusted under 35 U.S.C. 154(b) by 0 days.

(21) Appl. No.: 10/419,214

(22) Filed: Apr. 21, 2003

(65) Prior Publication Data

US 2004/0179361 A1 Sep. 16, 2004

Related U.S. Application Data

(63) Continuation-in-part of application No. 29/177,300, filed on Mar. 10, 2003, now Pat. No. Des. 482,152.

(51) Int. Cl.[7] ..... F21L 4/02
(52) U.S. Cl. ..... 362/183; 362/276
(58) Field of Search ..... 362/183, 198, 362/202, 205, 208, 276, 435, 199, 197

(56) References Cited

U.S. PATENT DOCUMENTS 4,325,107 A * 4/1982 MacLeod ..... 362/183
4,345,304 A * 8/1982 Penney et al. ..... 362/183
6,434,032 B1 * 8/2002 Romano ..... 363/146
6,664,758 B2 * 12/2003 Yang ..... 320/107

FOREIGN PATENT DOCUMENTS

GB 2148628 A * 5/1985 ..... H02J 7/00

* cited by examiner

*Primary Examiner*—Stephen Husar
*Assistant Examiner*—Hargobind S. Sawhney
(74) *Attorney, Agent, or Firm*—Berenato, White & Stavish

(57) ABSTRACT

A portable utility light includes base support with a rechargeable battery. A light assembly is electrically connected to the rechargeable battery in the base support through a power cord removably connected to the base support. The power cord is adapted for selective connection to an auxiliary power source to provide a direct auxiliary power source for the light assembly. A power supply mechanism is also connected to a second connection portion of the base support to provide another power source to either charge the battery, power the light assembly or both. Another power cord may be employed to facilitate recharging the battery through the auxiliary power source. The work light thus provides multiple sources of power for the light as well as multiple sources of power for recharging the battery.

16 Claims, 9 Drawing Sheets

UTILITY LIGHT

This application is a Continuation-In-Part of of U.S. Design patent application No. 29/177,300 filed Mar. 10, 2003 now U.S. Pat. No. Des. 482,152.

BACKGROUND OF THE INVENTION

1. Field of the Invention

The present invention is directed to a utility light and more particularly to a versatile utility light capable of operation by a multiplicity of power sources.

2. Background of the Related Art

Utility lights are well known in the art and many configurations of AC powered work lights have existed for years. However, such AC powered lights suffer from the drawback that they must be connected to a permanent source of AC power such as common electrical outlets and are not portable are useable in remote locations. Such lights are dependent on a cord connected to the AC power source. Battery powered flashlights and other types of lights are also well known in the art. However, the batteries must be replaced when consumed. Some flashlights are known to contain rechargeable batteries. However, the batteries must both be removed from the light and charged in a battery charger, or the flashlight must be inserted in a designated charging station which is connected to a wall outlet. The need therefore exists for a portable utility light that can be powered by multiple sources as well as a need for a rechargeable utility light that can be recharged by multiple sources.

SUMMARY OF THE INVENTION

The present invention is directed to a portable utility light that may be operated by multiple sources of power. A base support contains a rechargeable battery. A light assembly is pivotally supported on the base support and is electrically connected to the rechargeable battery through a power cord removably connected to a first connector portion of the base support. The power cord is adapted for selective connection to an auxiliary power source such as a cigarette lighter receptacle of an automobile to provide a direct auxiliary power source for the light assembly. A power supply mechanism is also connected to a second connection portion of the base support to provide another power source to either recharge the rechargeable battery power the light assembly. The rechargeable batter is connected to the first and second connection portions of the base support in parallel to facilitate the ability for multiple sources of power for recharging the battery. A male/male plug cord may be employed to utilize the auxiliary power source to recharge the battery through the first connection portion. The work light thus provides a multiple sources of power for the light as well as multiple sources of power for recharging a battery disposed within the base support. The physical configuration of the utility light also provides a portable sturdy adjustable light source.

DETAILED DESCRIPTION OF THE PREFERRED EMBODIMENTS

Figure 1:
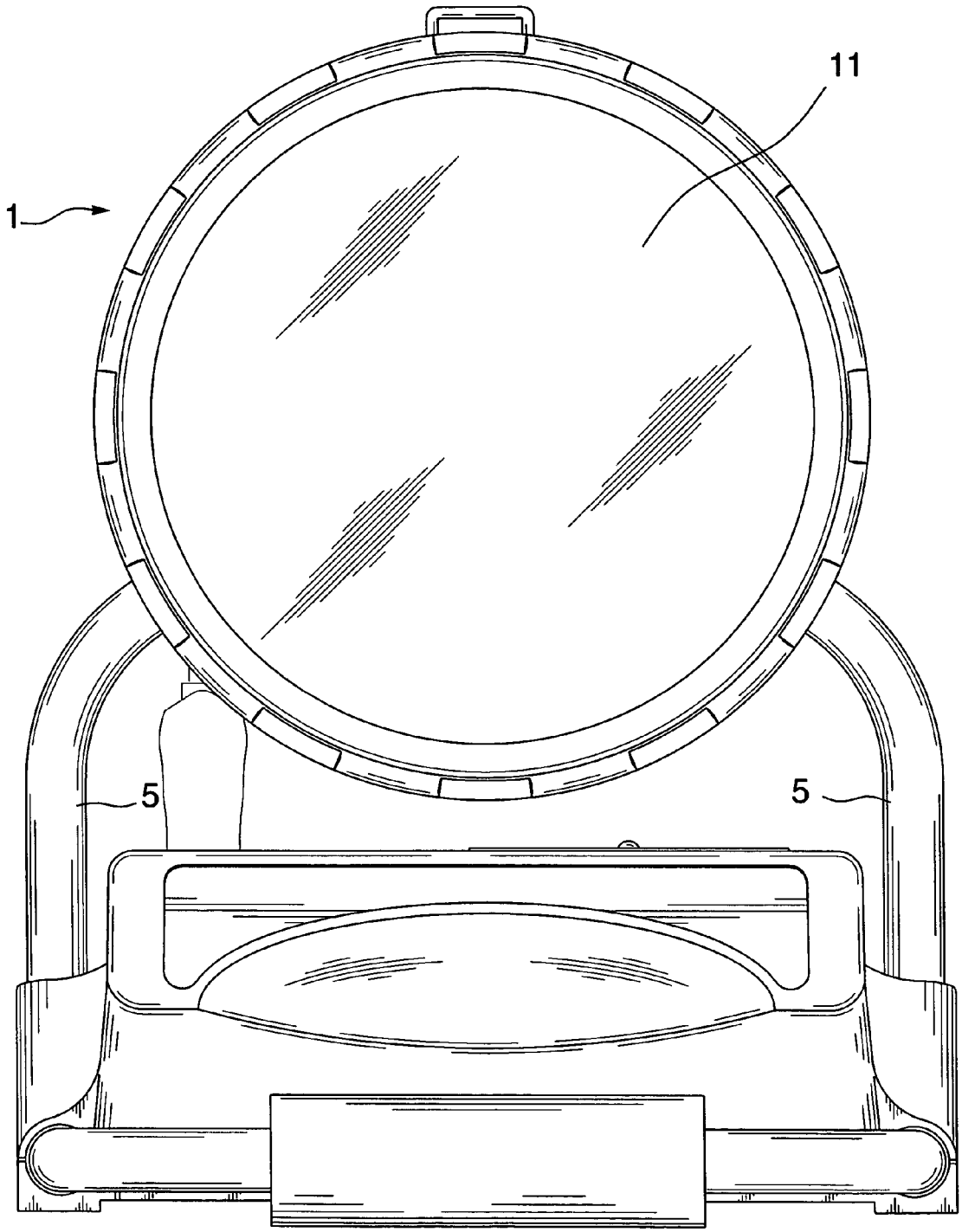
FIG. 1 is a front View of the Utility Light according to the present invention.
Figure 2:
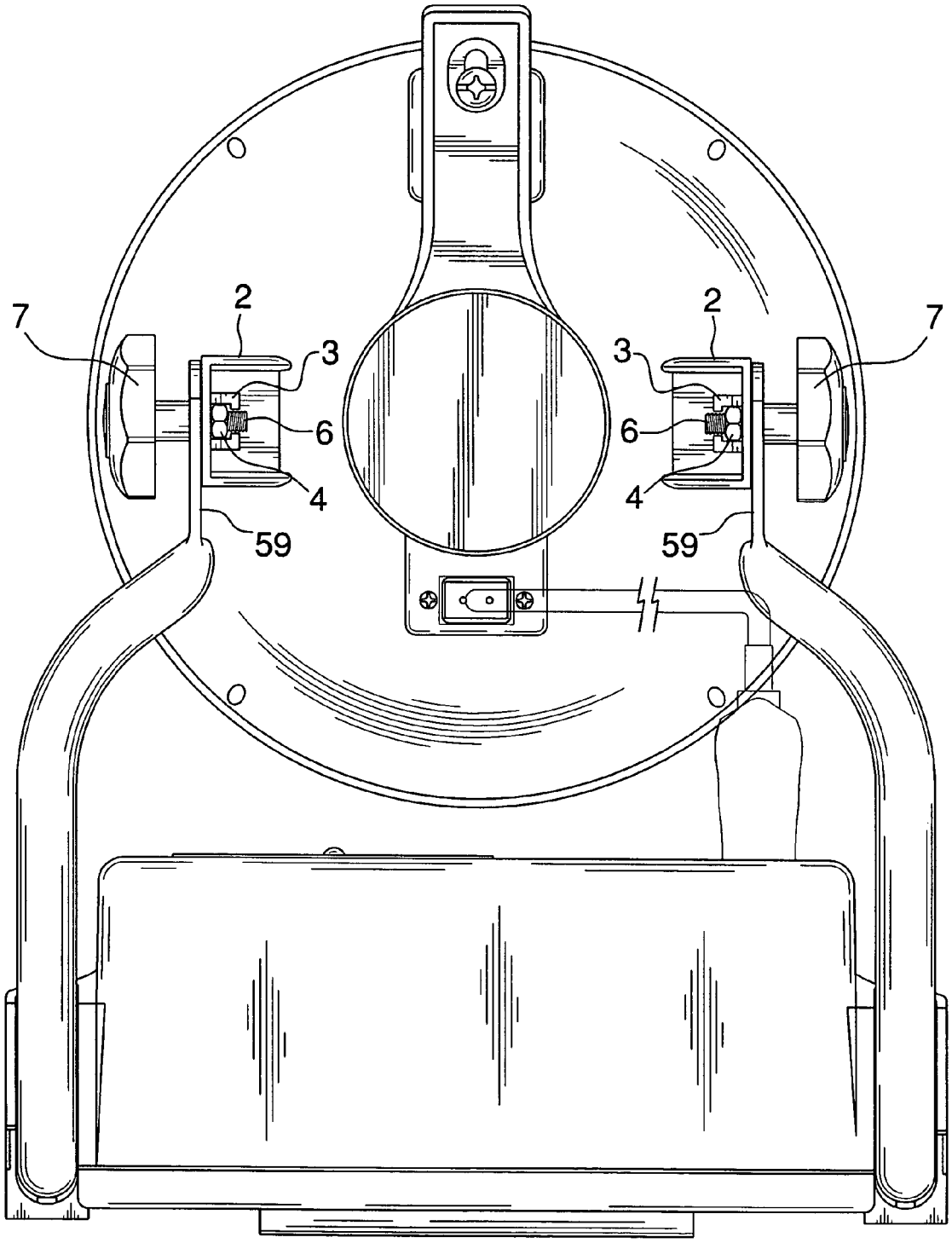
FIG. 2 is a rear view of the Utility Light of FIG. 1.
Figure 3:
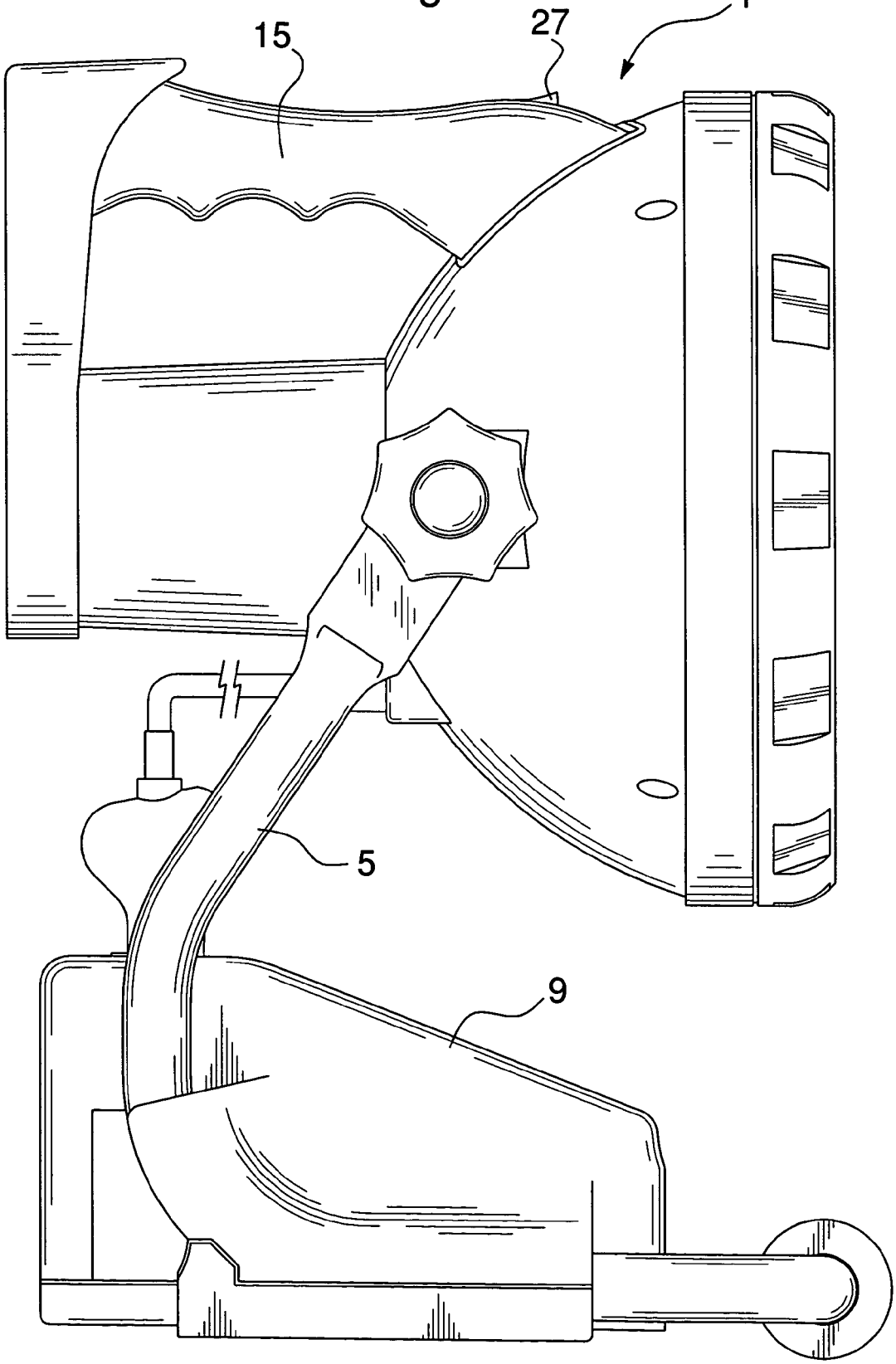
FIG. 3 is a left side view of the Utility Light of FIG. 1.
Figure 4:
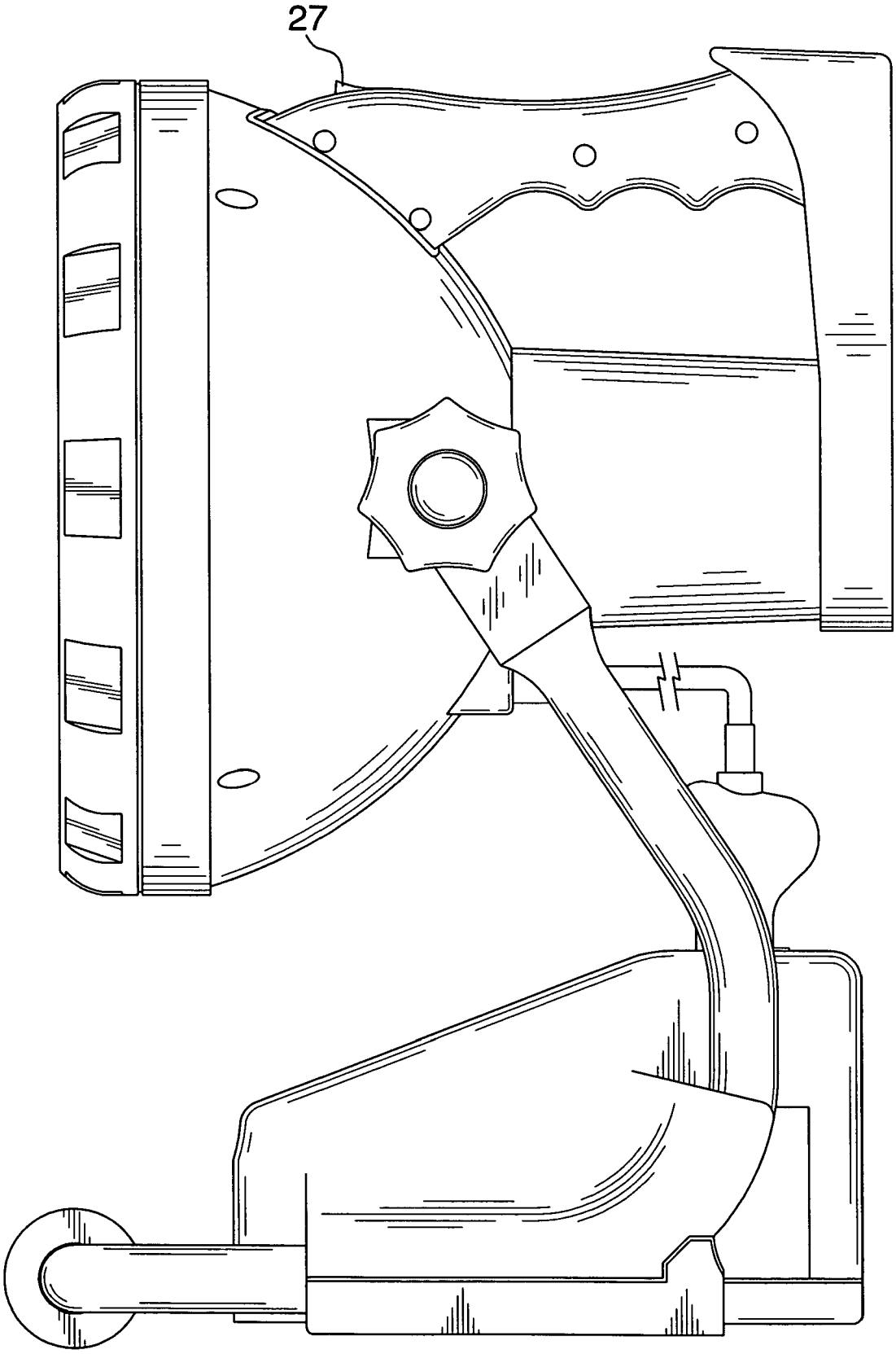
FIG. 4 is a right side view of the Utility Light of FIG. 1.
Figure 5:
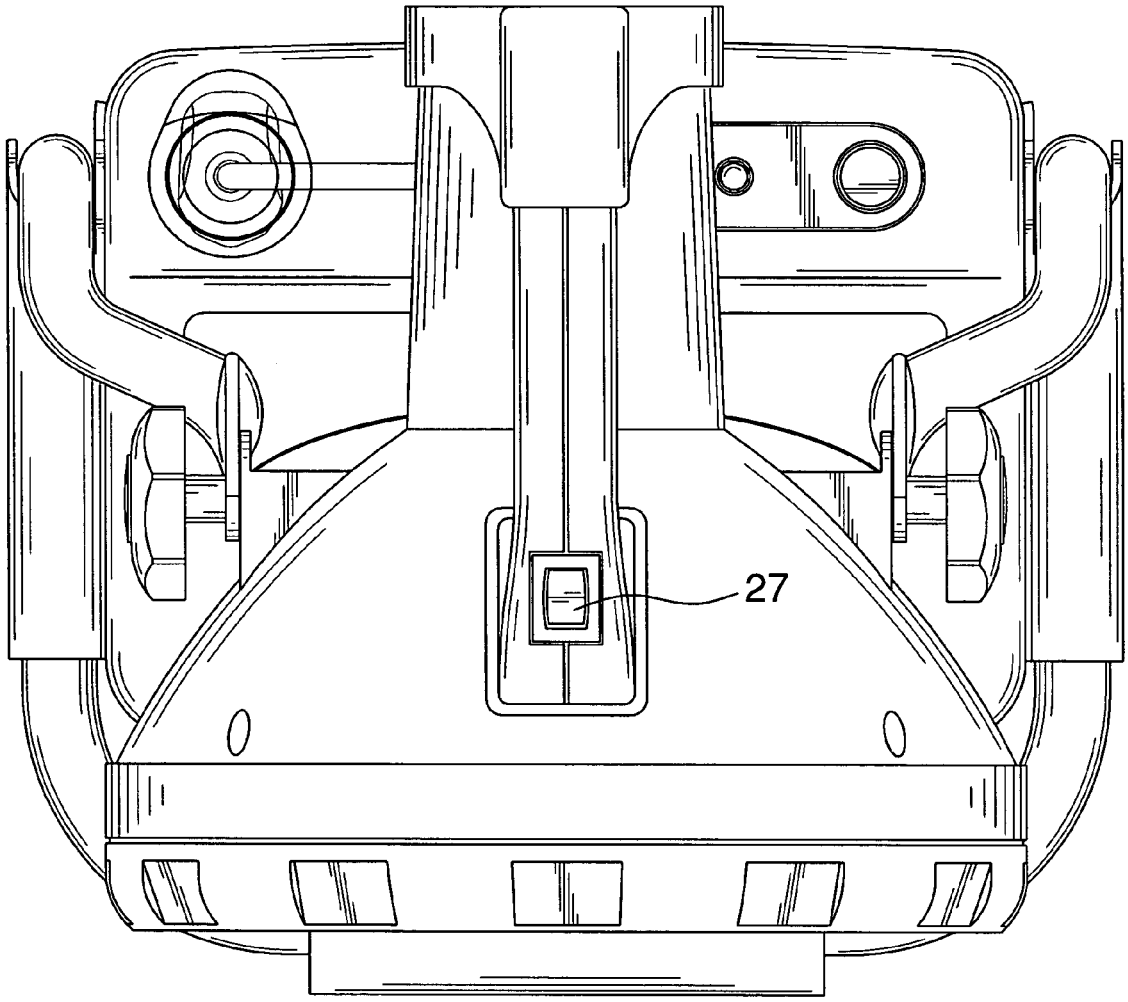
FIG. 5 is a top view of the Utility Light of FIG. 1.
Figure 7:
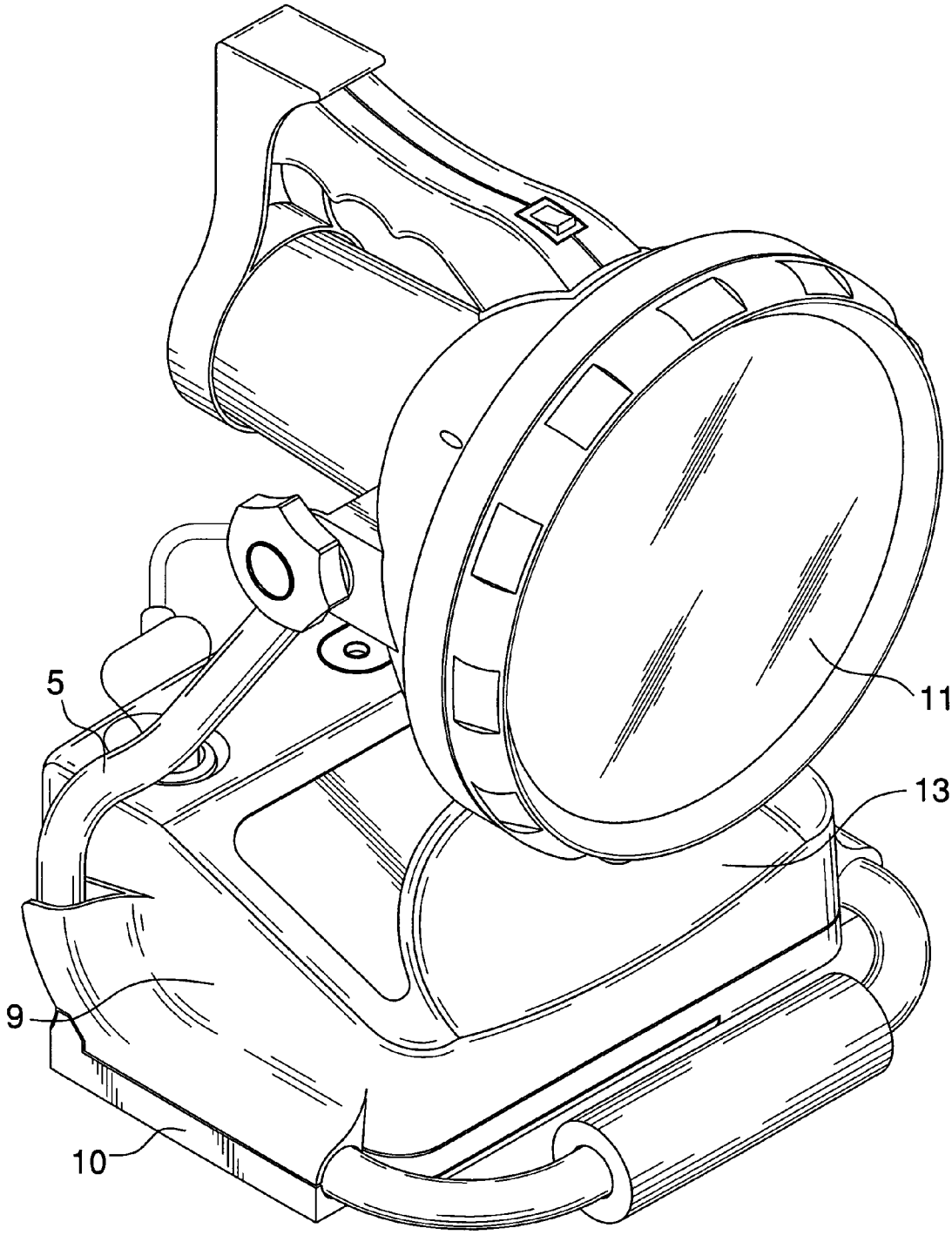
FIG. 7 is a front elevational perspective view of the Utility Light of FIG. 1.

Referring to FIG. 3, the present a light assembly 1 is pivotally connected to a pair of support arms 5 which in turn extends through apportion of a base support 9. Preferably the supporting arms include a single piece U-shaped like metal pipe that extends through a portion of the base support 9 and back up towards the light assembly 1. As best viewed in FIG. 7, the support arm 5 extends through a grooved recess formed in the base support 9. A bottom plate 10 is removably secured to the bottom of the base support 9 to allow for installation and removal of the support arm 5. The light assembly 1 with lens 11 is simply rotatably connected to the upper terminal ends of the support arm 5. Referring to FIG. 2, the light assembly 1 has a pair of brackets 2 extending from a light housing for connection to the support arms. The brackets have a grooved recess 3 formed thereon for non-rotatably containing a nut 4. The upper end of the support arms have flattened ends 5*a* with a hole which aligns with a hole extending through the brackets 2. A bolt with 6 having a hand engageable knob 7 is disposed through the bores of the support arms 5 and brackets 2 to engage nuts 4. The light assembly may simply rotate about the axis of the bolts and tightened to retain a selective position.

The light assembly 1 is generally shown in a horizontal position parallel to a plane of a support underneath the base support. However, the light assembly may be rotated into a vertical position such that the lens and associated light beam are directed upward in a vertical direction substantially orthogonal to a horizontal position. A contoured recess 13 is formed on the top surface of the base support 9 to accommodate a portion of the light assembly to allow the light assembly to rotate to a position below the horizontal position. Thus the light assembly may rotate through a range of motion exceeding ninety degrees. A handle 15 is also formed to extend from a back portion of the light housing and a rear most portion of the light assembly. The handle 15 enables a user to easily pivot the light assembly as well as carry the entire utility light.

Figure 8:
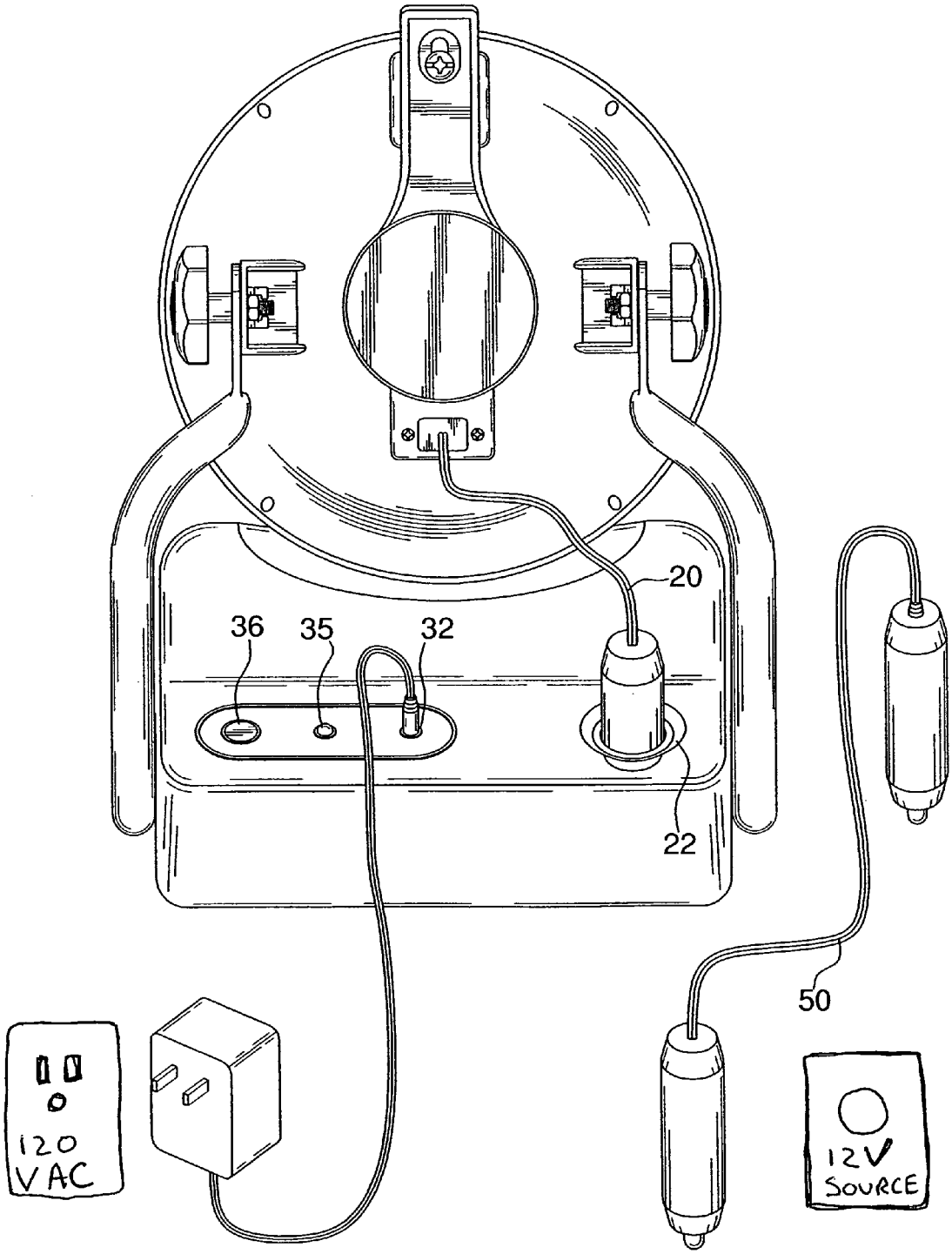
FIG. 8 is a rear elevational perspective view of the Utility Light of FIG. 1.

Referring to FIG. 8, a power cord 20 extends from a rear portion of the light assembly to the base support and is connected to a first electrically connection portion of the base support 9. Preferably the power cord 20 is connected to the first electrical connection portion via a cigarette lighter electrical connection. That is, the power cord 20 has a cigarette lighter male plug end inserted into a female cigarette receptacle 22 formed in the base support 9. The base support 9 carries a voltage source in the form of a rechargeable battery disposed within the base support 9. The rechargeable battery is electrically connected to the first electrical connection 22 thus establishing an electrical connection from the battery to the light assembly 1. It is to be understood that the basic wiring between the cord extending from the light assembly to the illumination source (light bulb) is well within the knowledge of one skilled in the art and need not be elaborated further. The power cord 20 may also be of significant length for connection to an auxiliary power source. For example, the male cigarette plug end of the power cord 20 may simply be connected to a cigarette lighter receptacle of an automobile which may be used as the auxiliary power supply to directly power the light. The light assembly 1 thus is capable of being powered by multiple sources: 1) rechargeable battery, auxiliary power supply, and an additional power supply to be discussed below.

An additional power supply mechanism is also provided to facilitate recharging the battery, independently powering the light, or both. A power supply, preferably a class 2 power supply converter which converts 120 VAC to 12 VDC at 500 ma, is connected to a second electrical connection portion 32 formed in the base support. Such converters are well known in the art and often service to power many portable devices such as TVs radios as well as recharge 12-volt battery supplies. The converter is simply inserted into a conventional AC electrical outlet and the other end connected to the second electrical connection portion 32 and the battery charges. The battery may also be charged by the auxiliary power source. Another power cord 50 with both ends formed with a male cigarette lighter plug is provided with the light assembly. The cord 50 may simply be plugged into the first electrical connection portion 22 as well as the female cigarette lighter receptacle of an automobile to provide another 12-volt source to charge the batter. Thus the battery may be charge by multiple sources.

An indicator LED light 35 is also incorporated into the base support 9 to indicate proper charging of the battery. When the battery is charged to a sufficient level above a threshold level, the LED 35 illuminates a certain color for example a green color when the button 36 is depressed. When the battery is being charged the LED indicator 35 continuously illuminates in a different color for example a red color. An indicator circuit connecting the light 35 and button 36 is incorporated into the base support 9 and connected in parallel to the second connection portion 32. The wiring circuit can be a currently available off the shelf indicator circuit which is generally known to those of skill in the art.

Figure 6:
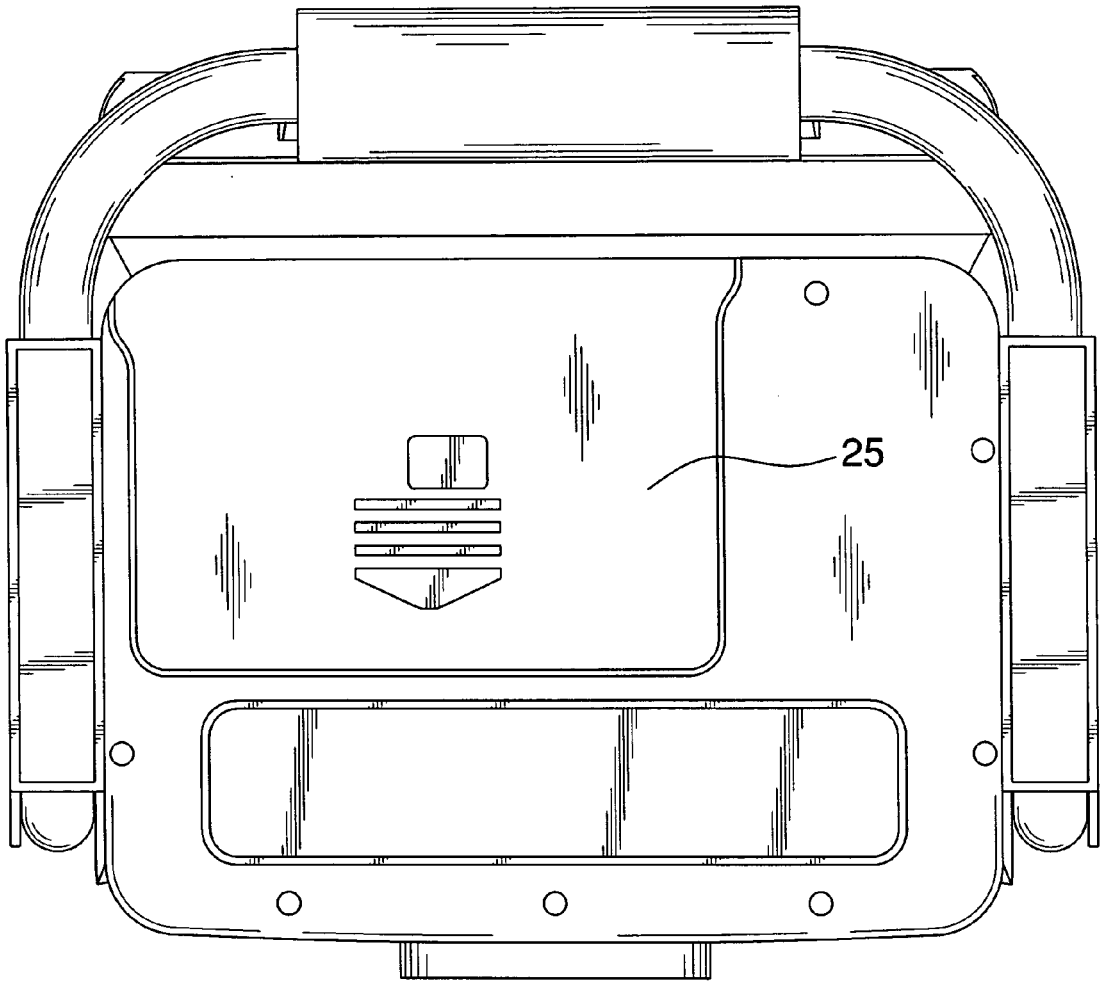
FIG. 6 is a bottom view of the Utility Light of FIG. 1.
Figure 9:
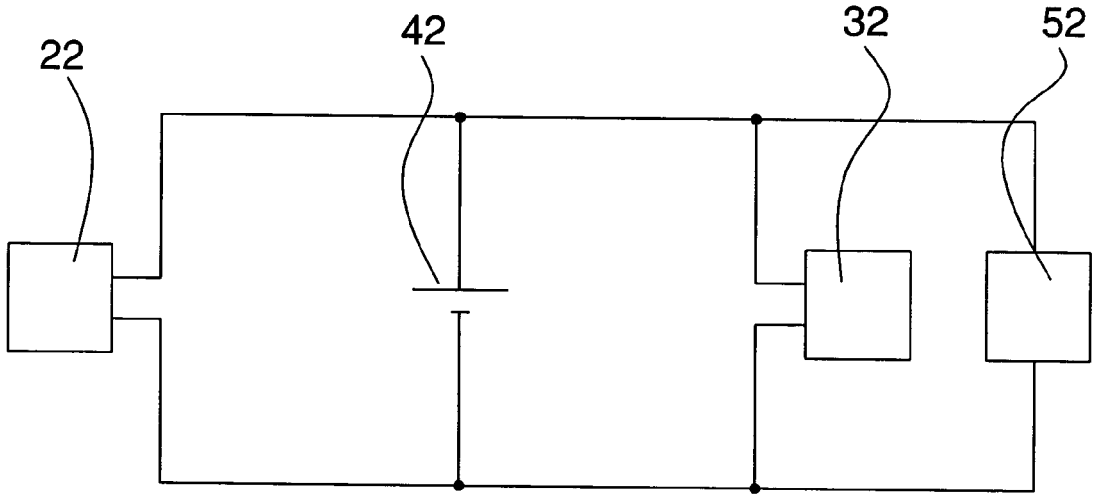
FIG. 9 is a schematic representation of the wiring between the electrical connections of the base support.

The rechargeable battery 42, schematically shown in FIG. 9, is removably disposed within the base support 9. The bottom plate 10 is removable exposing the rechargeable batter and facilitating its removal and or replacement. An access panel 25, shown in FIG. 6, is also provided which opens to a storage chamber within the base support for storing power cord/power supply mechanisms and other accessories.

The light assembly also has a switch 27 disposed on the handle 15 adjacent the light housing. When the power cord 20 is connected to the first electrical connection portion 22, the switch simply selectively connects the battery to the light source for selective activation of the light.

FIG. 9 is a schematic representation of the basic wiring of the utility light power sources. The first connection portion (female cigarette lighter receptacle) 22 is electrically connected in parallel to the battery 42 which is also electrically connected in parallel to the second electrical connection portion 32. An indicator circuit 52 is connected in parallel to the second electrical connection portion 32. The rechargeable battery 42 is preferably a heavy duty sealed non-spillable lead 12-volt battery entirely contained within the base support 9. The utility light of the present invention and associated circuitry provides both multiple electrical sources to power the light assembly 1 as well as multiple sources to charge the battery 42.

While the foregoing invention has been shown and described with reference to a preferred embodiment, it will be understood by those possessing skill in the art that various changes and modifications may be made without departing from the spirit and scope of the invention.

What is claimed is:

1. A portable utility light comprising:

a base support;

a light assembly having a housing and a light disposed therein, said light assembly being connected to said base support;

a DC voltage source disposed within said base support; and an electrical cord having a first end connected to said light assembly and a second end removably secured to a first electrical connection portion of said base support for selective alternate engagement with an auxiliary power source, said electrical cord providing an electrical connection from one of said DC voltage source and said auxiliary power source to said light assembly.

2. The utility light according to claim 1, wherein said DC voltage source is a rechargeable battery disposed within said base support.

3. The utility light according to claim 2, further comprising at least one power supply mechanism to facilitate recharging said rechargeable battery while disposed in said base support.

4. The utility light according to claim 3, wherein said power supply mechanism includes a converter adapted to connect to an AC power supply outlet and convert said AC power supply to a DC power output, said converter having a connector for connection to a second electrical connection portion of said base support to facilitate an electrical connection from said converter to said rechargeable battery disposed within said base support.

5. The utility light according to claim 3, wherein said at least one power supply mechanism comprises an auxiliary cord connecting said auxiliary power source to said first electrical connection portion of said base support and thereby establishing an electrical connection between said auxiliary power source to said rechargeable battery to facilitate recharging thereof.

6. The utility light according to claim 3 wherein said at least one power supply mechanism comprises at least two alternate power supply mechanisms to recharge said rechargeable battery, a first one of said alt least two alternate power supply mechanisms including;

a converter adapted to connect to an AC power supply outlet and covert said AC power supply to a DC power output, said converter having a connector for connection to a second electrical connection portion of said base support to facilitate an electrical connection from said converter to said rechargeable battery disposed within said base support; and a second one of said at least two alternate power supply mechanisms including;

an auxiliary cord connecting said auxiliary power source to said first electrical connection portion of said base support and thereby establishing an electrical connection between said auxiliary power source to said rechargeable battery to facilitate recharging thereof.

7. The utility light according to claim 6, wherein said electrical cord is connected to said first electrical connection portion of said base support through a standard cigarette lighter electrical connections said standard cigarette lighter electrical connection is formed of a male plug component formed in said second end of said electrical cord and a female receptacle component formed in said base support, said male plug component adapted for connection to a second female receptacle component of said auxiliary power source; and said auxiliary cord having two male plug components disposed on opposite ends thereof to facilitate an electrical connection between said first electrical connection portion of sad base support and a standard cigarette lighter female receptacle of an automobile.

8. The utility light according to claim 1, wherein said electrical cord is connected to said first electrical connection portion of said base support through a standard cigarette lighter electrical connection.

9. The utility light according to claim 8, wherein said standard cigarette lighter electrical connection is formed of a male plug component formed in said second end of said electrical cord, and wherein said first electrical connection portion is in the form of a female receptacle component formed in said base support, said male plug component adapted for connection to a second female receptacle component of said auxiliary power source.

10. The utility light according to claim 1, further comprising:

a support arm extending from said base support and pivotally connected to said light assembly and supporting said light assembly above a top surface of said base support.

11. The utility light according to claim 10, wherein said top surface of said base support comprises a contoured recess to accommodate a portion of said light assembly therein to facilitate rotation of said light assembly through a range of motion exceeding ninety degrees.

12. The utility light according to claim 11, wherein when said base support rests on a substantially horizontal surface said light assembly may rotate from a substantially vertical position casting a light beam substantially in said vertical direction above and orthogonal to said horizontal surface to a second position casting said light beam in a direction below said horizontal surface.

13. The utility light according to claim 1, wherein said light assembly further includes a handle to accommodate a firm grip of a user.

14. A portable utility light comprising:

a base support;

a light assembly having a housing and a light disposed therein, said light assembly being connected to said base support;

a DC voltage source disposed within said base support; and an electrical cord having a first end connected to said light assembly and a second end removably secured to a first electrical connection portion of said base support for selective alternate engagement with an auxiliary power source, said electrical cord providing an electrical connection from one of said DC voltage source and said auxiliary power source to said light assembly; and a power supply mechanism including a converter adapted to connect to an AC power supply outlet and covert said AC power supply to a DC power output, said converter having a connector for connection to a second electrical connection portion of said base support to facilitate an electrical connection from said converter to said rechargeable battery disposed within said base support.

15. The utility light according to claim 14, wherein said first electrical connection of said base support, said rechargeable battery and said second electrical connection of said base support are all connected in parallel to facilitate operation of said light powered by either one of said rechargeable battery and said power supply mechanism and said rechargeable battery may be recharged by either one of said power supply mechanism and said auxiliary power source.

16. A portable utility light in combination with an auxiliary power source of electrical energy, said utility light comprising:

a base support;

a light assembly having a housing and a light disposed therein, said light assembly being connected to said base support;

a DC voltage source disposed within said base support; and an electrical cord having a first end connected to said light assembly and a second end removably secured to a first electrical connection portion of said base support for selective alternate engagement with said DC voltage source and said auxiliary power source, said electrical cord providing an electrical connection from one of said DC voltage source and said auxiliary power source to said light assembly;

said auxiliary power source having a second electrical connection portion;

wherein said first and second electrical connection portions are of the same type.

* * * * *